United States Patent [19]

Markowitz

[11] 4,134,323

[45] Jan. 16, 1979

[54] SPATIALLY SEPARATED TONAL EFFECTS FOR AN ELECTRONIC MUSICAL INSTRUMENT

[75] Inventor: Jerome Markowitz, Allentown, Pa.

[73] Assignee: Allen Organ Company, Macungie, Pa.

[21] Appl. No.: 804,573

[22] Filed: Jun. 8, 1977

[51] Int. Cl.[2] ..... G10H 1/02

[52] U.S. Cl. ..... 84/1.27; 84/1.24; 179/1 G; 84/DIG. 1

[58] Field of Search ..... 84/1.01, 1.27, 1.24, 84/DIG. 1, DIG. 4, 1.03; 179/1 G, 1 GA, 1 GP, 1 GQ

[56] References Cited

U.S. PATENT DOCUMENTS

| | | | |
|---|---|---|---|
| 3,866,505 | 2/1975 | Adachi | 84/1.03 |
| 3,871,247 | 3/1975 | Bonham | 84/1.03 |

*Primary Examiner*—Robert K. Schaefer
*Assistant Examiner*—Leonard W. Pojunas, Jr.
*Attorney, Agent, or Firm*—Seidel, Gonda & Goldhammer

[57] ABSTRACT

Spatially separated high frequency tonal effects from an electronic musical instrument having less tone generators than keys selectable. A high frequency speaker system is provided in addition to the normal audio system. The audio signals produced by the tone generator are applied to a high pass filter-amplifier circuit before application to a tweeter switch. Digital logic is provided to demultiplex the note generator capture signal for note generator assignment information. The demultiplexer information is applied to the tweeter switches to effect the activation of a tweeter switch and permit the sounding of the tweeter speaker. Thus it may be seen that the present invention permits the separate soundings of the high frequency range in a directional fashion, creating the movement of sound sources and changing spatial relationships in response to key activity.

7 Claims, 7 Drawing Figures

SPATIALLY SEPARATED TONAL EFFECTS FOR AN ELECTRONIC MUSICAL INSTRUMENT

BACKGROUND OF THE INVENTION

1. FIELD OF THE INVENTION

This invention resides broadly in the field of electronic musical instruments, and is particularly adaptable for use in instruments employing an electronic selection system for calling forth desired tones and voices to be produced by the instrument from tone generators less in number than the number of keys selectable. The principles of the present musical sounds are generated in response to the actuation of key switches regardless of whether those switches are actuated directly, i.e., by the musician's fingers, or indirectly, by the plucking of strings. The term key is used in a generic sense, to include depressible levers, actuable on-off switches, touch or proximity responsive devices, closable apertures and so forth. The present invention relates to the production of multiple or spatially separated tonal sources from an electronic musical instrument having tone generators less in number than the kays selectable.

2. DESCRIPTION OF THE PRIOR ART

In the past, electronic organs and similar electrical musical instruments have been designed to apply an electronic signal representing the desired sound output to one or several speaker units which respond to the electronic signal to produce the desired sound pattern. Each speaker unit may comprise several individual speakers adapted to produce a particular frequency range of sound, such as a woofer, a mid-range speaker, and a tweeter. Heretofore, such speaker units have been connected to the electronic signal producing portion of the organ in a manner that permits them to accept electronic signals from all or a substantial portion of the several signal producing circuits. Thus the same speaker unit may produce sounds extending over a relatively wide frequency range.

In a pipe organ a single pipe is provided for each note, and in a general way the number of musical notes produced by a pipe organ depends on the number of pipes. The note to be produced is generated by each individual pipe. Therefore a pipe organ has multiple individual point-sources of sound by virtue of having at least one pipe for each frequency or note.

In the present invention there is not a single note source per speaker as found in a pipe organ; however, due to the audio perception of the human ear the listener's attention will be drawn to the most recently activated speaker thereby perceiving the same effect as individual pipes sounding.

Multiple individual point-sources contribute to the overall quality of the so-called "organ sound" produced by pipe organs. It is recognized that multiple individual sources are a desirable component of "organ sound," and as such would enhance the quality of sound produced by an electronic musical instrument if it is incorporated therein. The equivalent of multiple individual sound sources could be duplicated in an electronic instrument by providing a separate speaker unit and amplifier for each note. However, in electronic musical instruments which have less tone generators in number than the number of keys available, there has been no ability to duplicate this sound. It is the object of this invention to provide spatially separated tonal sources using a number of speakers less than the number of keys selectable.

SUMMARY OF THE INVENTION

The present invention provides a new and unobvious means for achieving spatially separated tonal effects in an electronic musical instrument. Briefly, in accordance with the present invention, there is provided a high pass filter which accepts the common audio output generated in response to key selection and filters out the middle and low frequency range before application to the tweeter switch circuit. In the preferred embodiment, there is provided digital logic which demultiplexes the note generator capture signal to detect each active note generator and to enable the respective tweeter switch circuit.

BRIEF DESCRIPTION OF THE DRAWINGS

For the purpose of illustrating the invention, there are shown in the drawing forms which are presently preferred; it being understood, however, that the invention is not limited to the precise arrangement and instrumentalities shown.

DESCRIPTION OF THE PREFERRED EMBODIMENT

The preferred embodiment is most suitable for an electronic musical instrument, as described in U.S. Pat. No. 3,610,799, which employs a digital system for selecting the tone to be generated.

Figure 1:
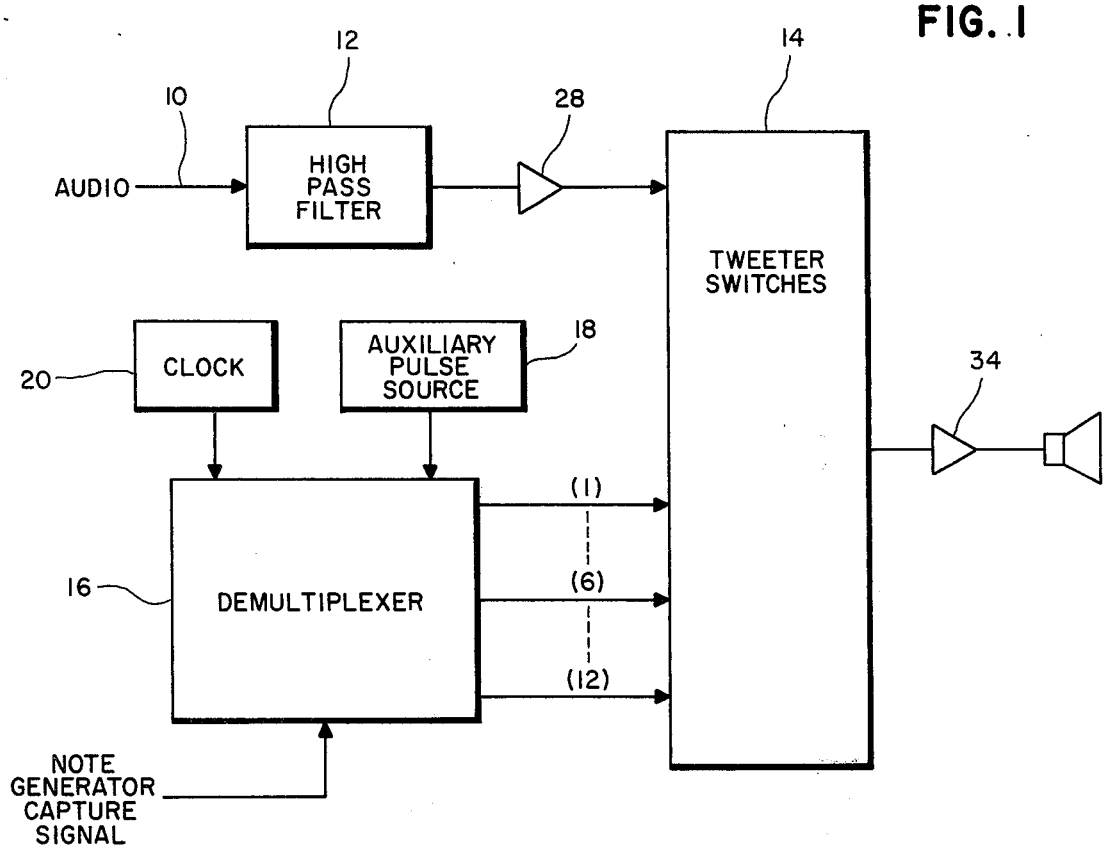
FIG. 1 is a schematic diagram, in block diagram form, of the prefered embodiment in accordance with the present invention.
Figure 2:
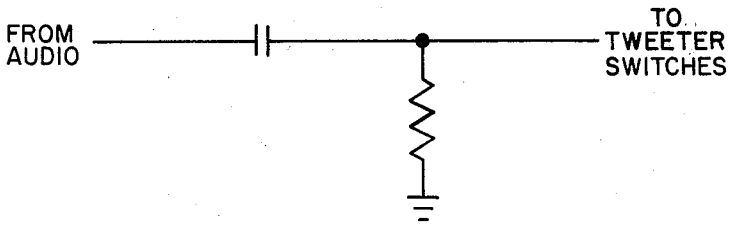
FIG. 2 is a schematic diagram of one possible embodiment of high pass filter 12 of FIG. 1.

Referring now to the drawings in detail, wherein like numerals indicate like elements, there is shown in FIG. 1 a block diagram of the preferred embodiment. The audio signal produced as a result of key actuation is applied to the normal audio system and a high pass filter circuit, 12 of FIG. 1. High pass filter circuits are well known in the art and need not be expanded upon in this disclosure. FIG. 2 shows a simple high pass filter which may be used in the preferred embodiment but is only one of many possibilities. The only requirement of the circuit selected is that it be a compatible interface with the subject instrument design. Referring again to FIG. 1, the audio signal from the high pass filter 12 is applied to the tweeter switches 14 of FIG. 1. A clock source, 20 of FIG. 1, synchronous with the instrument clock is applied to demultiplexer 16 of FIG. 1. An auxiliary pulse source, 18 of FIG. 1, is also applied to the demultiplexer 16 of FIG. 1. In the preferred embodiment the clock source typically runs at a 1 megahertz rate and the auxiliary pulse source is synchronous therewith and typically generates a 1 $\mu$ sec pulse every 12 $\mu$ sec. The number of pulses and the period of duration are not critical to the invention and result only from the application of same to the instrument of the preferred embodiment, as will become clear later. In addition to the clock and auxiliary pulse, the note generator capture signal, as described in U.S. Pat. No. 3,610,799, is applied to demultiplexer 16 of FIG. 1. The outputs of demultiplexer 16 of FIG. 1 are applied to tweeter switches 14 of FIG. 1 as described hereinafter. The outputs of tweeter switches 14 of FIG. 1 are applied to the respective speakers.

Figure 2A:
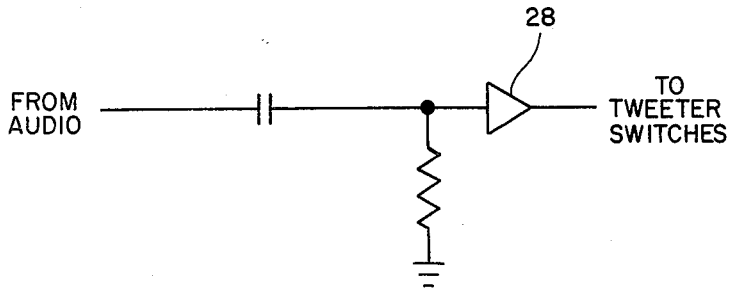
FIG. 2A is a schematic diagram showing the embodiment of FIG. 2 with amplifier 28 of FIG. 1.
Figure 3:
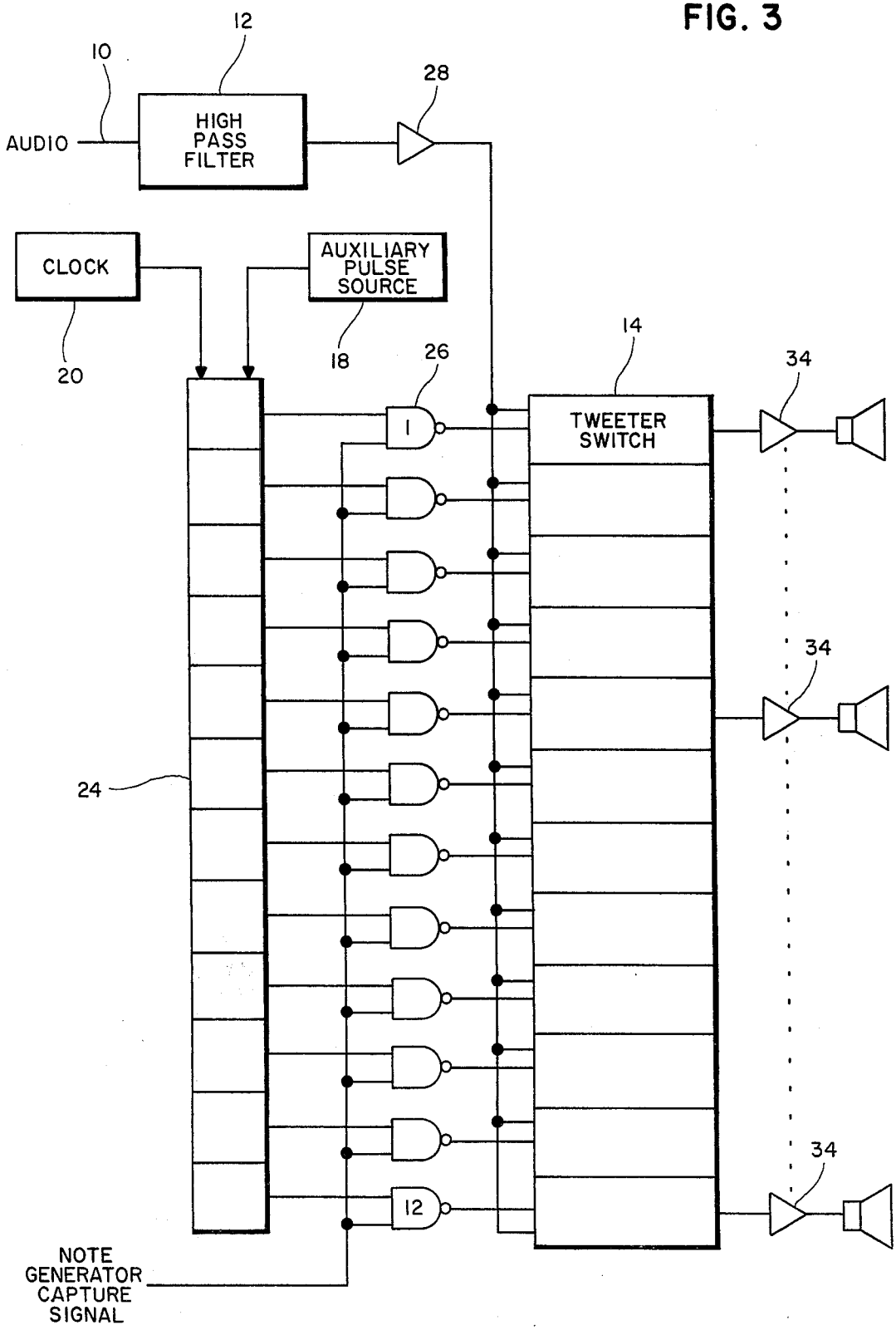
FIG. 3 is a schematic diagram, partially in block form, showing the demultiplexer 16 of FIG. 1 used in the preferred embodiment.

Referring now to FIG. 2A, there is shown a high pass filter with amplifier 28 which is compatible with the prefered embodiment. However, the circuit as drawn is not intended to limit the preferred embodiment but merely to illustrate one possible circuit. The respective values of the filter component are related to instrument design and the selection of values based on design is within the skill of the art. The only requirement of this circuit is that it filters out the undesired lower range frequencies and if desired, as in the instant instrument design, adds amplification to the desired high range frequencies. In the preferred embodiment the amplified signal is then present in common to the tweeter switches as shown in FIG. 3. In FIG. 3 there are shown twelve (12) tweeter switches, 14, related to the fact that the instrument incorporating preferred embodiment has twelve (12) tone generators. The number of tweeter switches may be less than, equal to, or greater than the number of tone generators depending upon instrument design and in no way affects the principle of the disclosed invention.

Figure 4:
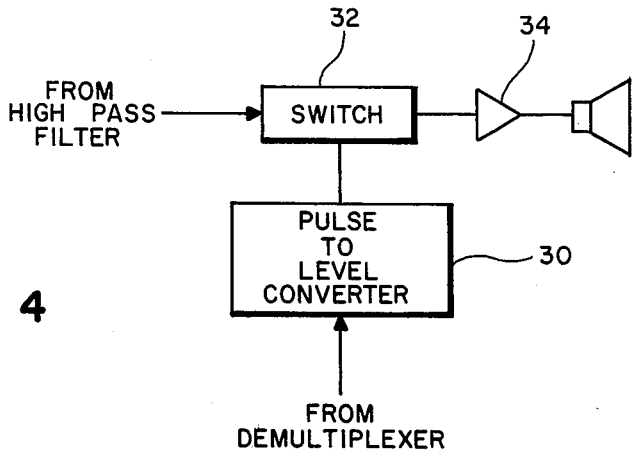
FIG. 4 is a block diagram of tweeter switch 14 of FIG. 3.
Figure 4A:
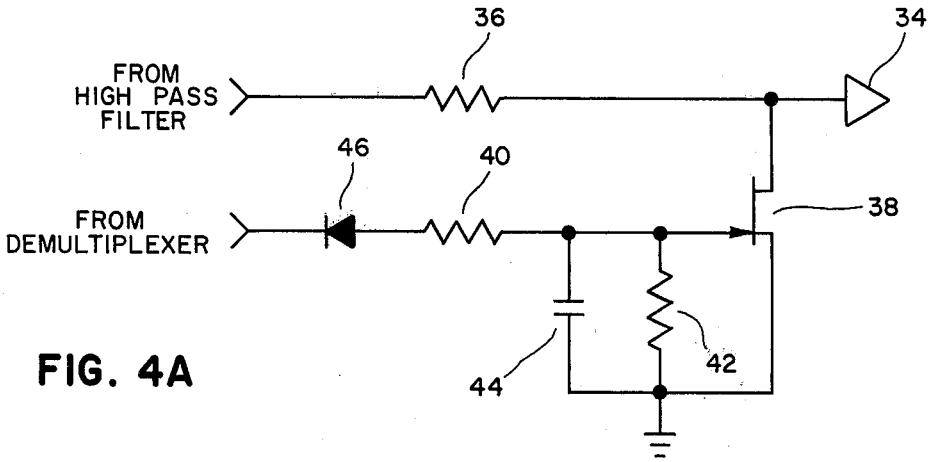
FIG. 4A is a schematic diagram of tweeter switch 14 of FIG. 3.
Figure 5:
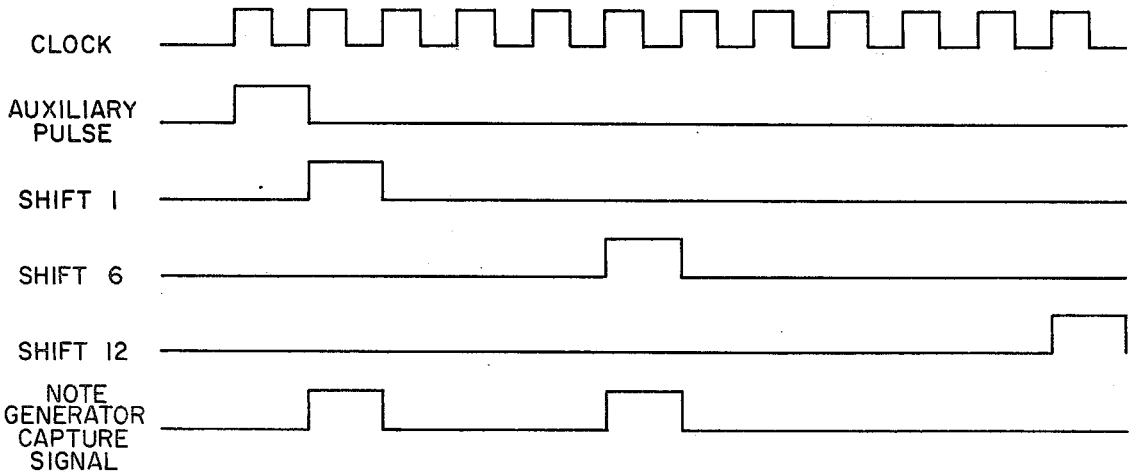
FIG. 5 is a timing diagram illustrating the operation of the present invention.

The function of demultiplexer 16 of FIG. 1 is well known in the art and its function may be performed by any demultiplexing means. The embodiment, 24 and 26 of FIG. 3, shown is only one of the many means for performing the demultiplexing function. Referring again to FIG. 3, there is shown a 12 bit shift register 24 which accepts the auxilliary pulse, typically of 1 $\mu$ sec. duration, and occurring every 12 $\mu$ sec., and advances the auxiliary pulse through the shift register in response to the clock, typically at a 1 megahertz rate. Other equivalent devices known in the art such as a ring counter may be substituted for the shift register 24. The parallel output of each bit of the shift register is applied to the respective NAND gate 26 of FIG. 3. Additionally, an eleven bit shift register could be used with the first stage applied directly to NAND gate 26 of FIG. 3. The note generator capture signal is applied in common to NAND gates 26 of FIG. 3. As a function of the NAND gate 26 when the high output of the respective bit of the shift register coincides with a high output on the note generator capture signal the respective NAND gate 26 will output a high thereby enabling the respective tweeter switch, e.g. see timing diagram FIG. 5. Thus it can be seen that the particular tweeter speaker which passes the sounds will depend on this coincidence. This moving assignment of speakers adds to the musical effect of the present invention. In the preferred embodiment, each tweeter switch 14 of FIG. 3 is a combination of a switch and a pulse to level converter, both of which are known in the art. FIG. 4 is a block diagram of a tweeter switch with amplification as presently used in the preferred embodiment. The amplifier 34 of FIG. 4 is not critical to the present invention and is added in the preferred embodiment only as a volume feature. FIG. 4A is a schematic diagram of the tweeter switch circuit as presently used in the preferred embodiment wherein the broken lines block out the respective components.

As can be seen from FIG. 4A, the switch circuit accepts the common output from the high pass filter 12 of FIG. 1, and the pulse to level converter accepts the output from the respective NAND gate 26 of FIG. 3. The function of this circuitry is well known in the art and does not require further explanation herein. The only requirement of the circuit as used in the preferred embodiment is that the voltage swing from the NAND gate 26 of FIG. 3 must be such that the diode 46 in the pulse to level converter be reversed biased when the NAND gate 26 output is high and forward biased when the output is low. A negative voltage from the NAND gate 26 of FIG. 3 will forward bias the diode in the pulse to level converter circuit resulting in a negative charge on the capacitor in the pulse to level converter circuit. The resulting voltage on the capacitor, 44, must be of sufficient magnitude to bring the field effect transistor, 38, in the switch circuit into the off condition, thereby allowing the audio signal to propagate through to the tweeter speaker. Additionally, the capacitor, 44, must have a discharge time of sufficiently long duration to ensure that the field effect transistor remains off between charge replenishments from the demultiplexer. When the activated signal from the demultiplexer is deactivated, the capacitor voltage returns to ground level placing the field effect transistor in the on condition. The function of resistor 42 is to assure that capacitor 44 is returned to ground before the next cycle.

In the prefered embodiment the shift register cycle typically is 12 sec in duration. It can be seen that if coincident pulses are not again presented at the respective NAND gate 26 FIG. 3, the output of NAND gate 26 is deactivated and the capacitor in the pulse to level control will discharge to ground thereby disabling the respective tweeter switch. It is obvious to one skilled in the art that the negative-positive relationship described above may be reversed according to instrument design.

The present invention may be embodied in other specific forms without departing from the spirit or essential attributes thereof and, accordingly, reference should be made to the appended claims, rather than to the specification as indicating the scope of the invention.

I claim:

1. In a multiplexed electronic musical instrument having less note generators than switches selectively actuable to cause the production of a common full range audio signal by said note generators and a note generator capture signal to indicate that a note generator channel has been captured by a switch, an apparatus for producing spatially separate tonal effects corresponding to the pattern of capture of said note generator channels, comprising:

a filter means for filtering out the undesired audio frequencies from said full range audio signal, clocking means, demultiplexing means responsive to said note generator capture signal and said clocking means for producing plural pulsed control signals based on said pattern of capture of said note generator channels, plural switching means for individually accepting the common audio output signal of said filter means and for selectively passing said audio output signal in response to said pulsed control signals, and plural speaker means connected to said plural switching means for producing said spatially generated tonal effects in response to said audio output signal passed by said switching means.

2. The apparatus of claim 1 wherein said switching means includes a pulse to level converter means for accepting the pulsed output of said demultiplexing means and for producing a leveled control signal.

3. The apparatus of claim 2 further comprising:

a plurality of amplifier means each to accept the respective output among said plurality of switching means for amplification before presentation to the respective speaker means among said plurality of speaker means.

4. The apparatus of claim 1 wherein said switching means comprises: a field effect transistor.

5. The apparatus of claim 1 wherein said demultiplexing means comprises:

an auxiliary pulse source synchronous with said clocking means for producing an auxiliary pulse, a shift register with a plurality of parallel bit outputs to accept said clocking means output and said auxiliary pulse for sequencing said auxiliary pulse through said parallel bit outputs, a plurality of detecting means for accepting said shift register parallel bit outputs and said note generator capture signal to detect coincident presence of true logic on both signals and to output said pulsed control signals in response thereto.

6. In a multiplexed electronic musical instrument having less note generators than switches selectively actuable to cause the production of a common full range audio signal by said note generators and a note generator capture signal to indicate that a note generator channel has been captured by a switch, a method of obtaining spatially separate tonal effects corresponding to the pattern of capture of said note generator channels, comprising:

filtering out the undesired audio frequencies from said common full range audio signal, demultiplexing said note generator capture signal to produce plural pulsed control signals based on said pattern of capture of said note generator channels, and accepting the filtered audio output signal of said filtering step in a switching means responsive to said pulsed control signals of said demultiplexing step and selectively passing the filtered audio signal to a speaker.

7. The method of claim 6 including leveling the pulsed control signal of said demultiplexing step in a pulse to level converter.

* * * * *